US008136177B2

(12) United States Patent
Kan

(10) Patent No.: US 8,136,177 B2
(45) Date of Patent: Mar. 20, 2012

(54) ASSEMBLED WATER RESERVOIR

(76) Inventor: Kuo-Ying Kan, Mountainside, NJ (US)

( * ) Notice: Subject to any disclaimer, the term of this patent is extended or adjusted under 35 U.S.C. 154(b) by 176 days.

(21) Appl. No.: 12/690,624

(22) Filed: Jan. 20, 2010

(65) Prior Publication Data

US 2011/0173746 A1 Jul. 21, 2011

(51) Int. Cl.
*E04H 4/00* (2006.01)

(52) U.S. Cl. ..... 4/506

(58) Field of Classification Search ..... 4/488–513, 4/538; 405/79; 52/169.7; 220/9.4
See application file for complete search history.

(56) References Cited

U.S. PATENT DOCUMENTS 3,439,362 A * 4/1969 Goettl ..... 52/169.7
4,356,933 A * 11/1982 Connolly ..... 220/9.4
4,756,033 A * 7/1988 Schelfhorst ..... 4/506
5,161,264 A * 11/1992 Dugas ..... 4/506
7,574,834 B2 * 8/2009 Murray ..... 52/169.7
7,784,227 B2 * 8/2010 Ribeiro ..... 52/169.7
2008/0201838 A1 * 8/2008 West ..... 4/506

* cited by examiner

*Primary Examiner* — Lori Baker
(74) *Attorney, Agent, or Firm* — Muncy, Geissler, Olds & Lowe, PLLC

(57) ABSTRACT

An assembled water reservoir includes plural boards. Each board is provided side by side on side walls of a tank unit. The water reservoir also includes plural connection members and each connection member is used to connect two neighboring boards, allowing an included angle to be formed between the two neighboring boards, so as to construct a water pool. Therefore, through providing the plural boards and the plural connection members in the closed tank unit to construct the water reservoir, the reservoir can be provided with an effect of isolating temperature, a power source, ambient moisture and water.

5 Claims, 5 Drawing Sheets

ASSEMBLED WATER RESERVOIR

BACKGROUND OF THE INVENTION a) Field of the Invention

The present invention relates to a quickly assembled water reservoir and more particularly to a water reservoir which is dismantled and installed conveniently and can be assembled to a tank unit.

b) Description of the Prior Art

In general, an existing water reservoir, bathing pool or swimming pool is constituted primarily by a tank unit into which water is filled.

However, for these water pool structures, as the tank unit is made by cement and some water pools are even provided with stone bricks paved on the cement, they will not only waste time, but also have a relatively high cost.

Moreover, as the tank unit is made by the cement, when the water is filled into the tank unit, the water will directly contact cement walls. As being easily affected by weather, the cement walls will be sometimes cold and sometimes hot, depending upon the weather change. In addition, the cement temperature can be easily transferred to the water, thereby affecting the water temperature of the pools.

On the other hand, as the cement walls are even easier to be affected by construction to cause water permeation or water leak. If these pools are located at a roof top of a house, the water can be easily permeated into the house below, causing the water to leak into the house at a top floor. Moreover, as the roof top is equipped with the water pool, the top house can be very humid by excessive moisture, thereby affecting a living quality of the house.

In addition, as the water is directly in touch with the cement walls, there will be even leak of electricity, which will affect safety of the water pool.

SUMMARY OF THE INVENTION

The primary object of the present invention is to provide a water reservoir which can be dismantled and installed conveniently and can be assembled to a tank unit.

To achieve the aforementioned object, the quickly assembled water reservoir of the present invention is installed in a closed tank unit having plural side walls and a bottom plane. The water reservoir includes plural boards and each board is provided side by side on the side walls of the tank unit. The water reservoir also includes plural connection members and each connection member is used to connect two neighboring boards, allowing an included angle to be formed between the two neighboring boards, thereby constituting a closed water reservoir.

Accordingly, through providing the plural boards and the plural connection members in the closed tank unit to construct the water reservoir, the water pool can be provided with effects of isolating temperature, a power source, ambient moisture and water.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
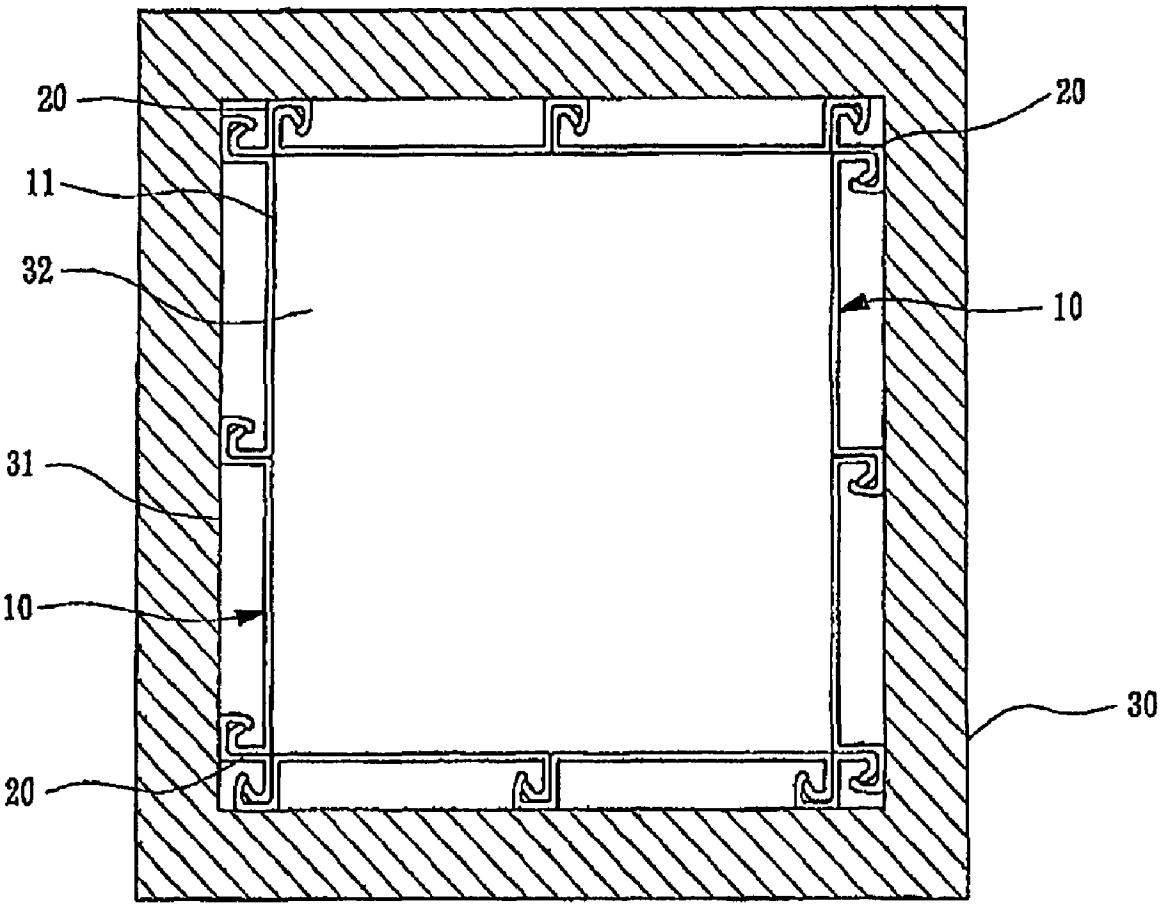
FIG. 1 shows a plan view of the present invention.
Figure 2:
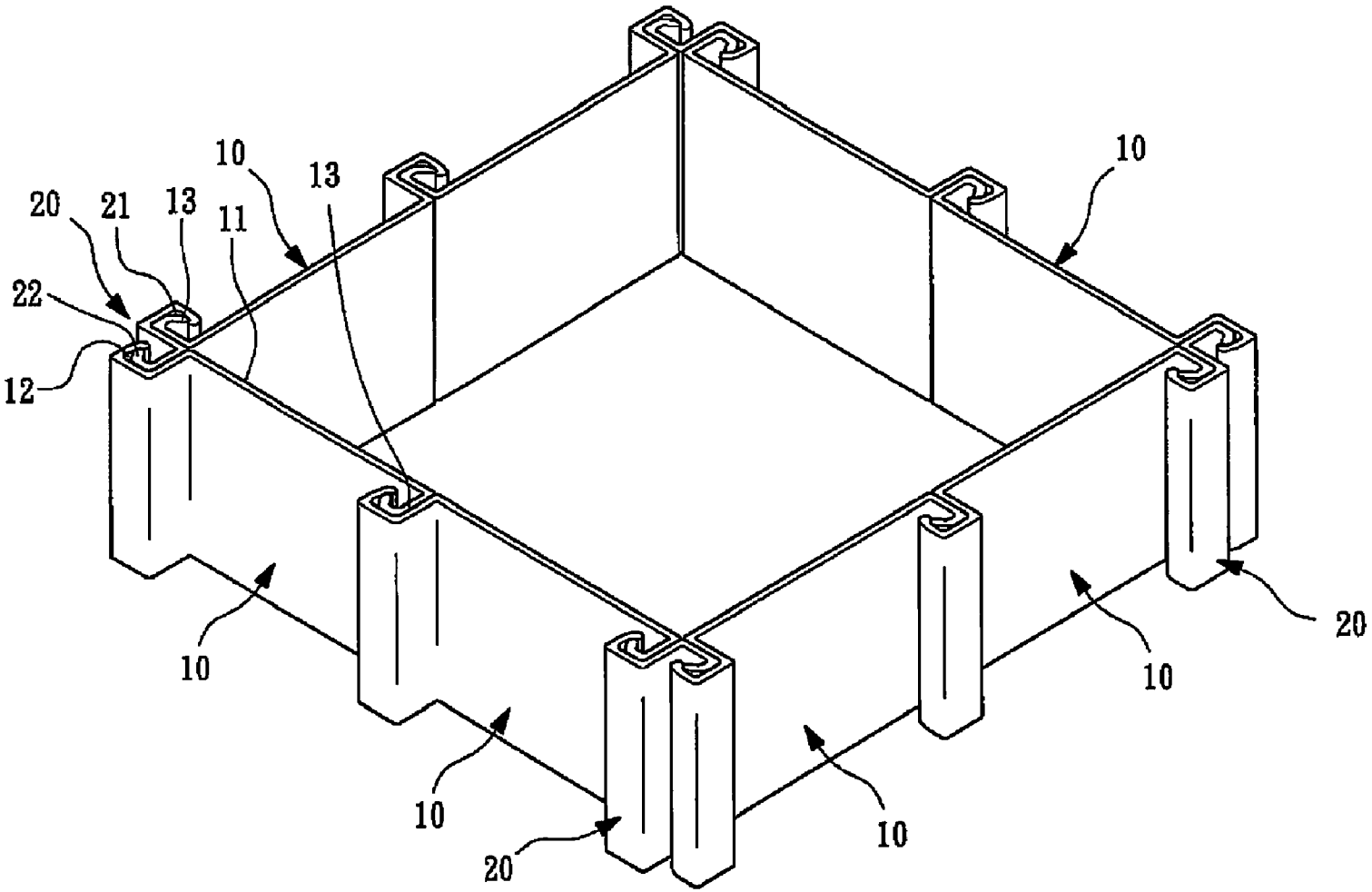
FIG. 2 shows a three-dimensional schematic view of the present invention.

Referring to FIG. 1 and FIG. 2, a quickly assembled water reservoir of the present invention is installed in a closed tank unit 30 which is provided with plural side walls 31 and a bottom plane 32; whereas, in the present embodiment, the tank unit 30 is provided with four side walls 31 and one bottom plane 32. The water reservoir comprises plural boards 10 and each board 10 is provided side by side on the side walls 31 of the tank unit 30. In the present embodiment, each side wall 31 is provided with two boards 10 and each board 10 in a side wall 31 is in a plane. In FIG. 1, one of the planes 11 is indicated. A first C-shaped pocket 12 is provided on a side of the plane 11 and is protruded forward and a first J-shaped pillar 13 which is provided on a side of the plane 11 corresponding to the first C-shaped pocket 12 and is protruded downward. The water reservoir also includes plural connection members 20 and each connection member 20 is used to connect two neighboring boards 10, allowing the two neighboring boards 10 to be vertically provided, thereby constituting a closed water reservoir, bathing pool or swimming pool. Each connection member 20 is provided with a second C-shaped pocket 21 and a second J-shaped pillar 22 which are vertically installed. The second C-shaped pocket 21 is used to collect the first J-shaped pillar 13 of each board 10, whereas the second J-shaped pillar 22 is provided in the first C-shaped pocket 12 of each board 10.

Figure 3:
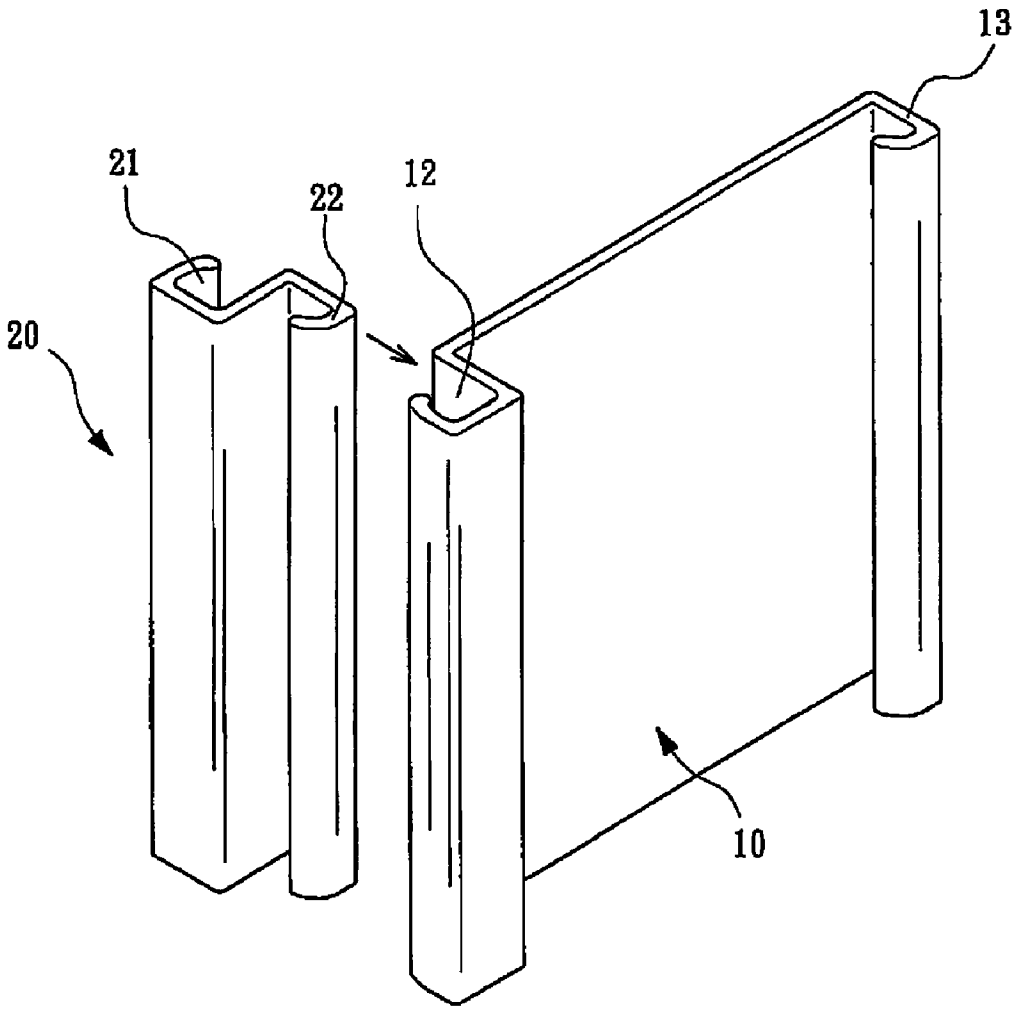
FIG. 3 shows an assembly drawing of the present invention.

Referring to FIG. 3, upon assembling, each connection member 20 is provided between two neighboring and vertically installed boards 10, wherein the second C-shaped pocket 21 of the connection member 20 is sheathed into the first J-shaped pillar 13 of the board 10, and then the second J-shaped pillar 22 is collected in the first C-shaped pocket 12 of the board 10, allowing each of the two neighboring and vertically provided boards 10 to be joined together through the connection member 20.

Besides, when the board 10 is connected with the connection member 20, a fixing element (not shown in the drawings) can be used for fixing. The fixing element can be screws or nails. In addition, a seam between each board 10 and each connection member 20 can be also fixed by an adhesive substance (not shown in the drawings) which can be a binding agent, such that the board 10 and the connection member 20 can be joined together more stably, thereby achieving an effect of quickly assembling the water reservoir in the tank unit 30.

Moreover, when the board 10 and the connection member 20 are fixed on the side wall 31 in the tank unit 20, the first C-shaped pocket 12 and the first J-shaped pillar 13 of the board 10 can be used, allowing a height difference to be formed between the plane 11 of the board 10 and the side wall 31 of the tank unit 30, thereby achieving an effect of isolating sound, temperature, a power source, moisture and water.

Figure 4:
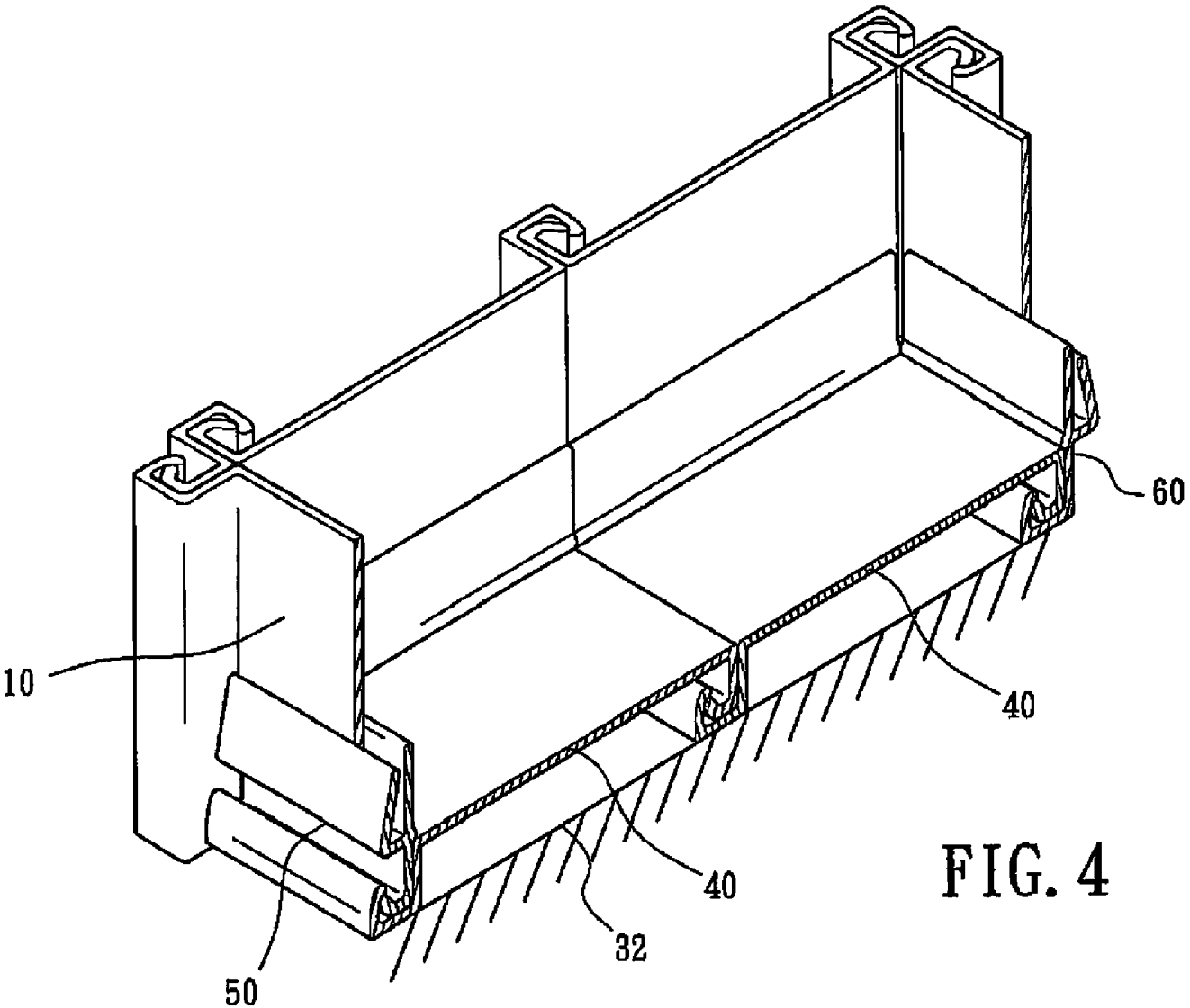
FIG. 4 shows a three-dimensional schematic view of a second embodiment of the present invention.
Figure 5:
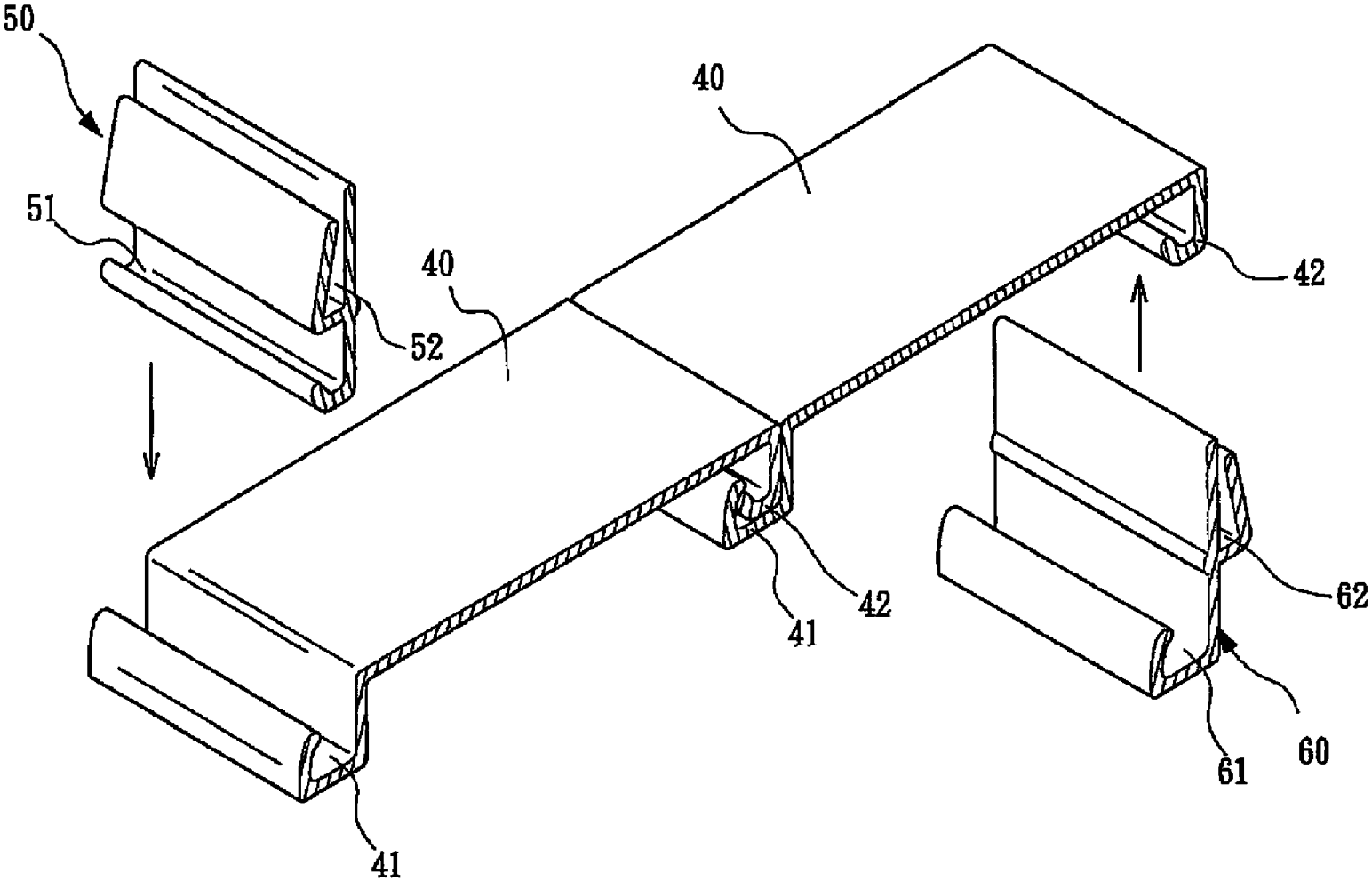
FIG. 5 shows a partial assembly drawing of the second embodiment of the present invention.

Referring to FIG. 4 and FIG. 5, a bottom plate 40, plural first clamps 50 and second clamps 60 are further included. The bottom plate 40 is provided on the bottom plane 32 of the tank unit 30. In the present embodiment, there are two bottom plates 40 and each bottom plate 40 includes a third C-shaped pocket 41 and a third J-shaped pillar 42, whereas each first clamp 50 includes a fourth J-shaped pillar 51 and a first U-shaped clamp 52, and each second clamp 60 is provided with a fourth C-shaped pocket 61 and a second U-shaped clamp 62.

Upon assembling, the two bottom plates 40 are connected together, followed by installing the fourth J-shaped pillar 51 of the first clamp 51 in the third C-shaped pocket 41 of the bottom plate 40, allowing the board 10 to be inserted into the first U-shaped clamp 52. Next, the third J-shaped pillar 42 of the bottom plate 40 is collected in the fourth C-shaped pocket 61 of the second clamp 60. Finally, another corresponding board 10 is inserted into the second U-shaped clamp 62 of the second clamp 60, and then the two corresponding boards 10 can be provided on two corresponding ends of the bottom plate 40. Therefore, the height difference between the bottom plate 40 and the bottom plane 32 of the tank unit 30 can be formed through the third C-shaped pocket 41 and the third J-shaped pillar 42, thereby achieving the effect of isolating sound, temperature, a power source, moisture and water.

Accordingly, the plural boards 10 and the plural connection members 20 of the present invention can be utilized in the tank unit 30 to quickly assemble a water reservoir, bathing pool or swimming pool, which is also provided with the effect of isolating sound, temperature, a power source, moisture and water.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An assembled water reservoir installed in a closed tank unit having plural side walls and a bottom plane, comprising:

plural boards, with each board being side by side on the side walls of the tank unit; and plural connection members, with each connection member connecting two neighboring boards forming an included angle between the two neighboring boards, thereby constructing a closed water tank, wherein each board is provided with a plane, a first C-shaped pocket which is provided on a side of the plane and is protruded forward and a first J-shaped pillar which is provided on a side of the plane corresponding to the first C-shaped pocket and is protruded downward, whereas each connection member is provided with a second C-shaped pocket and a second J-shaped pillar, with the second C-shaped pocket holds the first J-shaped pillar of each board and the second 1-shaped pillar being provided in the first C-shaped pocket of each board.

2. The assembled water reservoir according to claim 1, wherein the second C-shaped pocket and the second J-shaped of the connection member are vertically provided.

3. The assembled water reservoir according to claim 1, further comprising a bottom plate provided on the bottom plane of the tank unit and a first clamp and a second clamp which are provided at two corresponding sides of the bottom plate to connect the bottom plate and the boards.

4. The assembled water reservoir according to claim 3, wherein a side of the bottom plate is provided with a third C-shaped pocket and a third J-shaped pillar, the first clamp is provided with a fourth J-shaped pillar which is provided at the third C-shaped pocket and a first U-shaped clamp which is used to clamp the boards, and the second clamp is provided with a fourth C-shaped pocket which is used to collect the third J-shaped pillar and a second U-shaped clamp which is used to clamp the boards.

5. An assembled water reservoir installed in a closed tank unit having plural side walls and a bottom plane, comprising:

plural boards; with each board being side by side on the side walls of the tank unit; and plural connection members, with each connection member connecting two neighboring boards forming an included angle between the two neighboring boards, thereby constructing a closed water tank, and a bottom plate provided on the bottom plane of the tank unit and a first clamp and a second clamp which are provided at two corresponding sides of the bottom plate to connect the bottom plate and the boards, wherein a side of the bottom plate is provided with a third C-shaped pocket and a third J-shaped pillar, the first clamp is provided with a fourth J-shaped pillar which is provided at the third C-shaped pocket and a first U-shaped clamp which is used to clamp the boards, and the second clamp is provided with a fourth C-shaped pocket which is used to collect the third J-shaped pillar and a second U-shaped clamp which is used to clamp the boards.

* * * * *